US005453033A

United States Patent [19]

Travinski

[11] Patent Number: 5,453,033

[45] Date of Patent: Sep. 26, 1995

[54] COMBINATION LIFE PRESERVER AND TROUSER BELT

[76] Inventor: A. Robert Travinski, P.O. Box 102, Washougal, Wash. 98671

[21] Appl. No.: 320,274

[22] Filed: Oct. 11, 1994

[51] Int. Cl.[6] ..... B63C 9/08

[52] U.S. Cl. ..... 441/119

[58] Field of Search ..... 441/88, 90–101, 441/106, 108, 111, 112, 113, 116, 119, 120, 121, 125

[56] References Cited

U.S. PATENT DOCUMENTS

| | | | |
|---|---|---|---|
| 3,119,132 | 1/1964 | Nayar | 441/96 |
| 4,360,351 | 11/1982 | Travinski | 441/94 |

FOREIGN PATENT DOCUMENTS

| | | | |
|---|---|---|---|
| 3451 | of 1882 | United Kingdom | 441/88 |
| 2159104 | 11/1985 | United Kingdom | 441/88 |

*Primary Examiner*—Jesus D. Sotelo
*Attorney, Agent, or Firm*—Eugene M. Eckelman

[57] ABSTRACT

A belt that can be fitted through belt loops of a pair of trousers for holding the trousers up is equipped with a pair of inflatable bladders, one on each side of the wearer. Controllable inflating means for the bladders are mounted on the belt, and when inflated expand outwardly along respective sides of the wearer. The bladders have a closed loop structure through which the wearer can extend the arms. A tie strip is provided across the front of the two bladders to hold them tightly against the body.

5 Claims, 2 Drawing Sheets

COMBINATION LIFE PRESERVER AND TROUSER BELT

BACKGROUND OF THE INVENTION

This invention relates to new and useful improvements in life preservers.

Inflatable safety belts have heretofore been provided which are arranged to be mounted around the waist and which are arranged to be inflated by a gas cartridge when needed. Furthermore, as shown in my U.S. Pat. No. 4,360,351, an inflatable safety belt is provided that is combined with a trouser belt. Thus, it is natural for a person to automatically have the life preserver in readiness since it is already around the waist in the belt loops. In an emergency, persons may not have time to seek out life preservers and put them on, whereas when the life preserver is combined with a trouser belt, it will be available for activation at all times.

SUMMARY OF THE INVENTION

According to the present invention and forming a primary objective thereof, an inflatable combined life preserver and trouser belt is provided that includes improvements over my prior structure, such improvements making it more simplified and more efficient in use.

A more particular object of the invention is to provide an inflatable belt of the type described that is simplified in structure and that provides a novel arrangement of inflatable bladders that expand out the sides of the person and have a looped structure through which the wearer can insert the arms.

Another object of the invention is to provide an inflatable belt which when expanded ensures that the wearer will float upright in the water.

Another object is to provide a manual inflation valve on the belt in the event that gas inflation means thereon is rendered inoperable or in the event that the wearer desires manual inflation.

In carrying out the above objectives, a combination life preserver and trouser belt is provided wherein the belt is dimensioned so that portions thereof can extend through the belt loops of trousers. A pair of inflatable bladders are mounted on the belt one on each side of the wearer whereby when the bladders are inflated they expand outwardly along respective sides of the wearer and provide a life preserver float that ensures that the wearer will float upright in the water. Each of the bladders forms a closed loop through which the wearer inserts the arms. Releasable connecting means are provided at the front that extend between the two inflated bladders for maintaining the life preserver in place with the bladders extending over the shoulders.

The invention will be better understood and additional objects and advantages will become apparent from the following description taken in connection with the accompanying drawings.

DETAILED DESCRIPTION OF A PREFERRED EMBODIMENT

Figure 4:
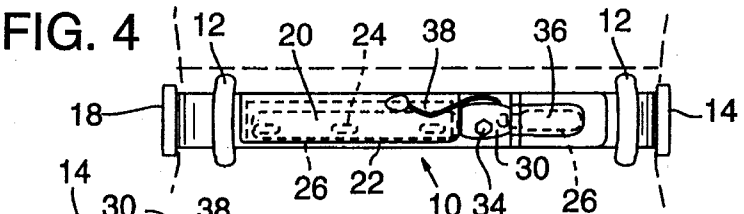
FIG. 4 is a side elevational view of the invention.

With reference to the drawings, the combination life preserver and trouser belt of the invention is designated generally by the numeral 10. In its function, the belt is arranged to serve as a normal trouser belt worn through the conventional loops 12 of the trousers, best seen in FIGS. 1 and 4, whereby the belt while normally holding the trousers is also readily available when needed as a life preserver. With this structure, it is not normally necessary for a person to remember to keep a life preserver available or for an employer to require that a life preserver be readily available since the belt is already in place if installed as a conventional trouser belt.

Figure 2:
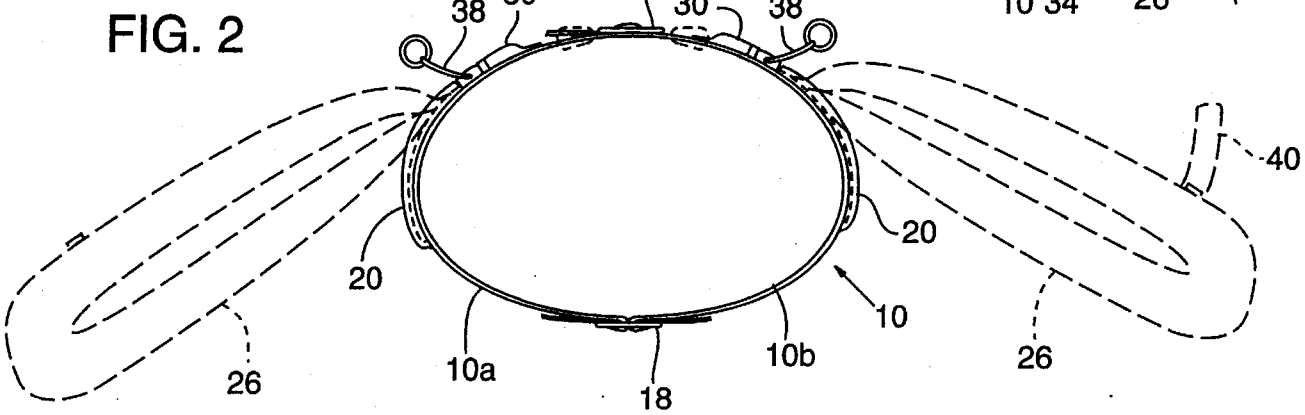
FIG. 2 Is a top plan view of the life preserver and trouser belt, an inflated bladder portion of the life preserver being shown in broken line.
Figure 3:
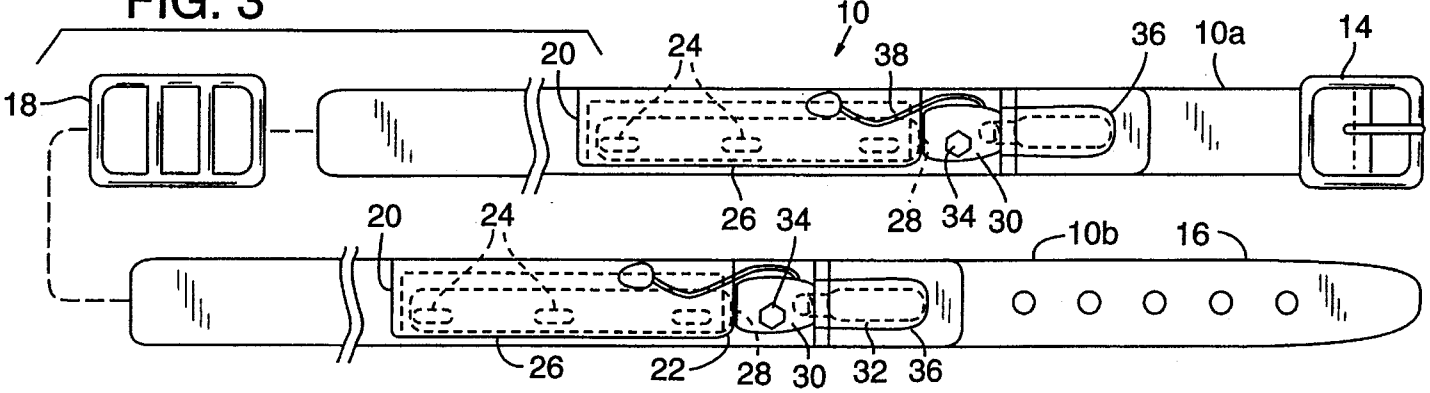
FIG. 3 is a composite elevational view of portions of the invention.

The belt of the invention comprises two halves **10*a* and 10*b*, FIGS. 2 and 3, which extend around opposite sides of the wearer and are joined at the front and rear. The front juncture of the two halves is a usual buckle 14 and adjusting apertured tab end 16. The rear of the belt portions are connected by an adjusting friction fastener 18**.

Each of the belt portions **10*a* and 10*b* has a pouch 20 secured to the outer surface thereof. These pouches have a closure flap 22 that has closure engagement with its pouch by Velcro connecting means 24. Pouches 20 hold a collapsed bladder 26, shown inflated in broken lines in FIG. 2**. Upon initial inflation of the bladders, the inflating force will rip the Velcro open and the bladders will expand outwardly.

Each bladder has an inlet end 28 that is secured interiorly to the pouch and communicates with an actuator 30 that removably receives the neck end of a gas cartridge 32 such as a conventional $CO_2$ cartridge. Actuator 30 is secured to the belt by a rivet 34 or the like, and the cartridge 32 has its base or rearward portion removably fitted into a pocket 36 formed on the belt with the open end facing the actuator 30.

Actuator 30 is of conventional construction and includes a pull string 38 arranged when pulled to cause a punctured opening into the gas cartridge. Such actuator is of well known construction and may for example operate similar to that shown in U.S. Pat. No. 3,263,249 which uses a piercing pin operated by a lever driven into the cartridge to release the pressured gas into the bladder when the pull string 38 is yanked.

Figure 1:
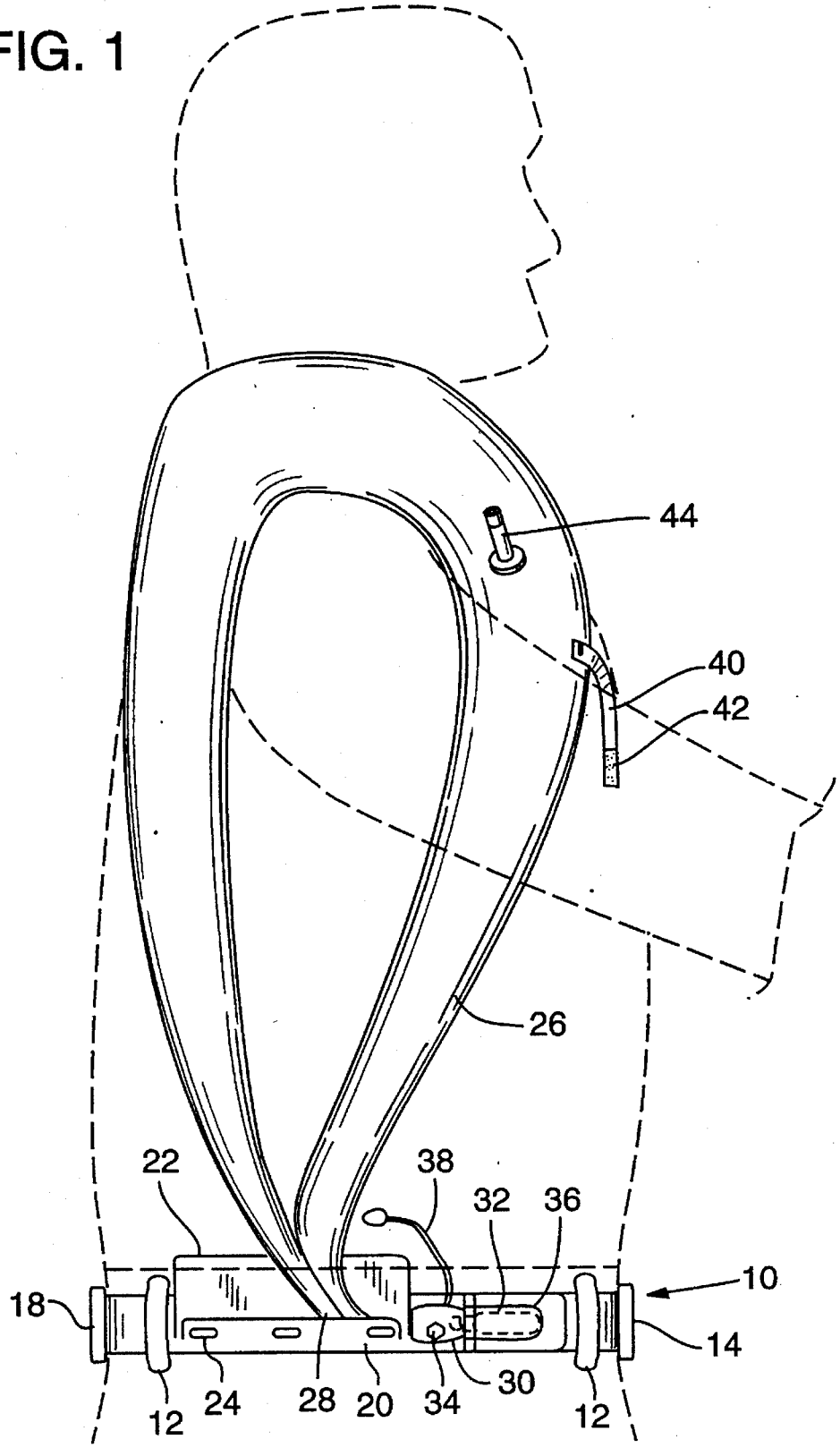
FIG. 1 is a side view of the combination life preserver and trouser belt of the invention in inflated condition, the wearer being shown in dash lines.

With reference to FIGS. 1 and 2, the bladder 26 has a loop structure when inflated. Thus a central opening is provided through which the wearer can insert the arms. One of the bladders has a connecting strip 40 having a Velcro end 42 capable of releasable attachment to a cooperating Velcro patch, or other Velcro connector, not shown, mounted on the other bladder.

Each of the bladders 26 has a manual inflation valve 44 by means of which the wearer can blow up the bladder in the event that the gas inflation means is inoperable or also if the wearer desires to use manual inflation.

In operation, the wearer simply installs the belt on his or her trousers in the same manner as any other trouser belt, and since the belt is used to hold up trousers, the person or the person's employer can reasonably be assured that the life preserver is always in place and ready for inflation. One or two trouser loops may have to be skipped in the portion of the belt occupied by the bladders but a good connection to the trousers is still maintained. To inflate the life preserver, the wearer merely pulls the pull string 38. This causes actuation of the bladder which forces the Velcro closed flap 22 open to allow the bladders to inflate. Each of the bladder expands outwardly at the sides of the wearer and forms a loop through which the wearer inserts the arms. After inserting the arms, the front connecting strip 40 is attached whereby the life preserver is securely attached in place close to the neck.

The present life preserver is simplified in structure and inexpensive to manufacture. It is easy to activate, and the bladders extend outwardly on each side of the wearer to always maintain the wearer floating in upright position. As stated herein, the life preserver is worn as a belt and critical time of installing it is saved in the event of an emergency. Also, with two independently operable bladders, a safety factor exists in the event of malfunction of one of the bladders. If required, one or both of the bladders may be manually inflated by the valves 44.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A combination life preserver and trouser belt comprising:

a belt having portions thereof with a structure that can be fitted through the belt loops of a pair of trousers whereby the life preserver serves both as a life preserver and a belt that extends around the front, rear and sides of a person, a pair of inflatable bladders secured to said belt one on each side of the wearer, and controllable inflating means on said belt for said bladders, said bladders when inflated in water expanding outwardly along respective sides of the wearer to the neck and providing a life preserver that causes the wearer to float upright in the water, said bladders when inflated comprising a closed loop through which the wearer is capable of inserting the arms.

2. The combination life preserver and trouser belt of claim 1 including releasable connecting means between the two inflated bladders at the front for maintaining the said bladders over the shoulders.

3. The combination life preserver and trouser belt of claim 2 wherein said releasable connecting means comprises a tie strip secured to one bladder that has a Velcro connection with the other bladder.

4. The combination life preserver and trouser belt comprising:

a belt formed of a pair of strips that can be fitted through the belt loops of a pair of trousers whereby the life preserver serves both as a life preserver and a belt that extends around the front, rear and sides of a person, a cooperating buckle and connecting apertured belt end at the front of the belt providing releasable and adjustable length securement around the waist of a person, cooperating eye loop means on each strip at the rear of said strips having cooperating connecting and length adjustment means with each other, and an inflatable bladder secured to each of said belt strips, said bladders when inflated comprising a closed loop through which the wearer is capable of inserting the arms.

5. The combination life preserver and trouser belt of claim 4 including releasable connecting means at the front extending between the two inflated bladders for maintaining the said bladders over the shoulders.

* * * * *